US008347579B2

(12) United States Patent
Gan

(10) Patent No.: US 8,347,579 B2
(45) Date of Patent: Jan. 8, 2013

(54) SEMI-BUTTERFLY CONNECTING CLAMP AND BUILDING STEEL FRAMEWORK JOINT STRUCTURE

(75) Inventor: Xiuming Gan, Beijing (CN)

(73) Assignee: Beijing Deli New Technology Of Steel Structure Co., Ltd., Haidian District, Beijing (CN)

( * ) Notice: Subject to any disclaimer, the term of this patent is extended or adjusted under 35 U.S.C. 154(b) by 146 days.

(21) Appl. No.: 12/990,489

(22) PCT Filed: May 21, 2008

(86) PCT No.: PCT/CN2008/071032

§ 371 (c)(1), (2), (4) Date: Oct. 29, 2010

(87) PCT Pub. No.: WO2009/132490

PCT Pub. Date: Nov. 5, 2009

(65) Prior Publication Data

US 2011/0047925 A1 Mar. 3, 2011

(30) Foreign Application Priority Data

Apr. 29, 2008 (CN) ..... 2008 1 0105377

(51) Int. Cl.
*E04H 12/00* (2006.01)

(52) U.S. Cl. ..... 52/655.1; 52/653.1; 52/656.1; 52/699; 52/838

(58) Field of Classification Search ..... 52/126.2, 52/126.7, 236.3, 236.7, 272, 647, 653.1, 52/655.1, 656.1, 698, 699, 831, 837, 838; 248/70, 213.4, 219.1, 219.3, 227.3, 228.1, 248/228.5

See application file for complete search history.

(56) References Cited

U.S. PATENT DOCUMENTS

| | | | | |
|---|---|---|---|---|
| 712,299 | A * | 10/1902 | Howland-Sherman | 52/301 |
| 6,237,303 | B1 * | 5/2001 | Allen et al. | 52/838 |
| 7,497,054 | B2 * | 3/2009 | Takeuchi et al. | 52/167.1 |
| 7,874,120 | B2 * | 1/2011 | Ohata et al. | 52/655.1 |

* cited by examiner

*Primary Examiner* — William Gilbert
*Assistant Examiner* — Patrick Maestri

(57) ABSTRACT

A semi-butterfly connecting clamp and a building steel framework joint structure are mainly used for connection of a building steel framework. The connecting clamp includes a bearing plate, two L-shaped self-locking blocks, and two clamp wings provided at two ends of the bearing plate, respectively. Each of the clamp wings is integrally formed by a pre-tightening plate and a self-locking fastening plate. A groove is provided at an end of the self-locking fastening plate near the bearing plate. A wedge-shaped piece, having an inclined upper surface and a locking bolt hole, is placed on the self-locking fastening plate at a position near the groove. The retaining distance of the connecting clamp can be conveniently adjusted according to the size of the retained vertical column, and it can weaken the destruction action of the applied outside force on the building steel framework when the outside force acts on the connecting clamp.

20 Claims, 5 Drawing Sheets

SEMI-BUTTERFLY CONNECTING CLAMP AND BUILDING STEEL FRAMEWORK JOINT STRUCTURE

BACKGROUND OF THE PRESENT INVENTION

1. Field of Invention

The present invention relates to a building structure connecting member, and more particularly to a semi-butterfly connecting clamp and a building steel framework joint structure.

2. Description of Related Arts

In building steel framework structures, the connection quality between the vertical column and the cross beam is the key to structural-load-bearing capacity and seismic resistant capability. The connection of conventional steel structure joint is generally formed by butt welding or welding connection combined with bolts. However, these methods have disadvantages in that there may be bad stress transmitting, stress concentration, greater probability of partial damage, mechanical property dependent on the material quality and wall thickness of the column, and low economical performance.

Chinese patent application No. 200510103007.7 discloses a butterfly-type self-locking connecting clamp with friction shear resisting plate and a building steel framework joint structure. As shown in FIGS. 1A and 1B, a schematic view of an existing butterfly self-locking connecting clamp structure and an isometric view of a corresponding building steel framework joint structure are provided, respectively. The building steel framework joint structure comprises a vertical column 1', a cross beam 2', four connecting clamps 3' and four friction shear resistant plates 11'. As shown in FIG. 1A, each of the connecting clamps 3' comprises a clamp main body 4'. Four clamp wings 5' are provided at two ends of the clamp main body 4', respectively, wherein each of the clamp wings 5' comprises a bearing plate 7' connected to the clamp main body 4', a pre-tightening plate 6' opposite to the bearing plate 7', and a self-locking fastening plate 9' connecting the bearing plate 7' with the pre-tightening plate 6', in which, the pre-tightening plate 6' and the self-locking fastening plate 9' are integrally formed. The self-locking fastening plate 9' has two through holes, and the pre-tightening plate 6' has one through hole. A projecting self-locking shoulder 8' is provided at an end of the self-locking fastening plate 9' near the clamp main body 4', an arc recess is provided between one end of the self-locking shoulder 8' and the clamp main body 4', and an inclined surface is provided between the other end of the self-locking shoulder 8' and the pre-tightening plate 6'. As shown in FIG. 1B, the clamp main body 4' is located on a side surface of the vertical column 1', two pre-tightening plates 6' are positioned opposite to each other, a web plate of the cross beam 2' is inserted between the two pre-tightening plates 6' opposite to each other, upper and lower flange plates of the cross beam 2' are arranged above and below the self-locking fastening plates 9', respectively. The two pre-tightening plates 6' are firstly fixed and connected to the web plate of the cross beam 2' by screws, and then the self-locking fastening plates 9' are connected with the upper and lower flange plates of the cross beam 2' by screws. The four friction shear resistant plates 11' are distributed evenly between the vertical column 1' and the cross beam 2'. Each of the friction shear resistant plate 11' is formed by a V-shaped friction plate 111' and a shear resistant plate 112', in which the friction plate 111' thereof is attached to an external surface of the vertical column 1', the shear resistant plates 112' of adjacent friction shear resistant plates and the web plate of the cross beam 2' therebetween are fixed together by bolts, and each shear resistant plate 112' is located below the cross beam 2'. The distance between the external surfaces of the two parallel upper and lower self-locking fastening plates 9' of the connecting clamp 3' may be determined according to the height of the cross beam 2' to be mounted, and the distance between the self-locking shoulder 8' at one end of the clamp main body 4' and that at the other end thereof in the same plane is determined according to the width of the vertical column 1' to be assembled. However, the connection structure of this building steel framework joint has its disadvantages in that: the distance between the parallel upper and lower self-locking fastening plates 9' must be fitted with the height of the web plate of the connected cross beam 2' for the connecting clamp's integrally design, otherwise, they will be hard to be connected together. As a result, there is the need to measure accurately their positions while designing, and the designed connecting clamp 3' only can be suitable to a single height cross beam 2'. Therefore, it is inconvenient to adjust the connection joint of the building steel framework joint. When the two self-locking shoulders 8' of the connecting clamp retains the friction shear resistant plates 11' on the outside surface of the vertical column 1' of the building steel framework, since the self-locking shoulder 8' is designed in a fixed form, the distance between its friction shear resistant plates 11' for retaining the outside surface of the vertical column 1' can not be adjusted. Hence, the retaining width of the self-locking shoulder 8' of the connection clamp must have been precisely calculated when producing, otherwise it is difficult to connect them to the friction shear resistant plates 11' of the vertical column 1'. On the other hand, when a strong outside force is applied on the building steel framework structure, for example, earthquake, the action between each of the prior connecting clamps 3' and each of the friction shear resistant plates 11' outside of the vertical column is a rigid action, all of the energy produced in this condition will be applied onto the vertical column 1', and thus it is easily to break the building steel framework joint structure. In order to overcome the above disadvantages in the prior art, the present applicant had made various improvements, and successively filed a series of patent applications. The present application is a continuation application of the above applications.

SUMMARY OF THE PRESENT INVENTION

An object of the present invention is to provide a semi-butterfly connecting clamp and a building steel framework joint structure, wherein the connection of the connecting clamp and the cross beam can be easily adjusted, the retaining distance of the connecting clamp can be conveniently adjusted according to the size of the friction shear resistant plate retained outside of the vertical column, and it can reduce the destruction action upon the building steel framework joint structure due to the applied outside force when the outside force acts on the connecting clamp.

Accordingly, in order to accomplish the above object, the present invention provides a semi-butterfly connecting clamp comprising a bearing plate, and two L-shaped clamp wings provided at left and right ends of the bearing plate, respectively, wherein each of the clamp wings and the bearing plate form a U-shaped clamp notch, each of the clamp wings is integrally formed by a pre-tightening plate opposite to the bearing plate and a self-locking fastening plate connecting the bearing plate with the pre-tightening plate, the self-locking fastening plate has at least two through holes, the pre-tightening plate has at least one through hole, a groove is provided at an end of the self-locking fastening plate near the bearing plate, a wedge-shaped piece with an inclined upper surface inclining toward a middle of the connecting clamp is placed on an upper surface of the self-locking fastening plate at a position near the groove, the wedge-shaped piece has a locking bolt hole perpendicular to the upper surface thereof, a surface of the groove facing to a groove opening thereof is perpendicular to the upper surface of the wedge-shaped piece, the connecting clamp further comprises two L-shaped self-locking blocks, two bolts and two springs, wherein a transverse rod at an upper part of each of the self-locking blocks has a through hole, a lower end of a vertical rod under the transverse rod is inserted into the groove and fitted with a surface of the groove, each of the bolts is fastened with the locking bolt hole together through the through hole and each of the spring located above or below the self-locking block.

According to the semi-butterfly connecting clamp of the present invention, the pre-tightening plate is parallel or inclines to the bearing plate.

According to the semi-butterfly connecting clamp of the present invention, the self-locking fastening plate has a circular arc recess between one end of the groove and the bearing plate, and a cambered surface or an inclined surface between the other end of the groove and the pre-tightening plate.

According to the semi-butterfly connecting clamp of the present invention, each of the springs is positioned between each of the self-locking blocks and the wedge-shaped piece when the upper surface of the wedge-shaped piece is an inclined surface inclining toward a middle lower part of the connecting clamp, or each of the springs is positioned above each of the self-locking blocks when the upper surface of the wedge-shaped piece is an inclined surface inclining toward a middle upper part of the connecting clamp.

A building steel framework joint structure comprises a vertical column, cross beams and four friction shear resistant plates distributed evenly on outer surfaces of four corners of the vertical column, respectively, wherein each of the friction shear resistant plates, located between the vertical column and each of the cross beams, is formed by a friction plate with a V-shaped or C-shaped cross section and two shear resistant plates connected with the middle parts of two sides of the friction plate, respectively, the shear resistant plates of adjacent friction shear resistant plates and the web plate of the cross beam between the two adjacent shear resistant plates are fixed together by bolts, wherein the building steel framework joint structure further comprises at least four connecting clamps, wherein each of the connecting clamp comprises a bearing plate, two L-shaped self-locking blocks, two bolts and two springs, wherein two clamp wing, each of which has an L-shaped section, are provided at left and right ends of the bearing plate, each of the clamp wings and the bearing plate form a U-shaped clamp notch, each of the clamp wings is integrally formed by a pre-tightening plate opposite to the bearing plate and a self-locking fastening plate connecting the bearing plate with the pre-tightening plate, the self-locking fastening plate has at least two through holes, a groove is provided at an end of the self-locking fastening plate near the bearing plate a wedge-shaped piece having an inclined upper surface inclining toward a middle of the connecting clamp is placed on an upper surface of the self-locking fastening plate at a position near the groove, a surface of the groove facing to a groove opening thereof is perpendicular to the upper surface of the wedge-shaped piece, and a wedge-shaped piece has a locking bolt hole perpendicular to the upper surface thereof, a transverse rod at an upper part of the self-locking block has a through hole, a lower end of a vertical rod under the transverse rod is inserted into the groove and fitted with a surface of the groove, each of the bolts is fastened with the locking bolt hole together through the through hole and each of the springs located above or below the self-locking block, wherein every two connecting clamps form a pair, the two connecting clamps of the pair are respectively located at two opposite sides of the vertical column, the pre-tightening plates of the pair of connecting clamps are placed opposite to each other, a flange plate of the cross beam is arranged above or below the self-locking fastening plates bolted with an upper or lower flange plates, the pre-tightening plate has at least one through hole, the pre-tightening plates of the pair are fastened opposite to each other by bolts.

According to the building steel framework joint structure of the prevent invention, the number of the cross beams is two, three or four, and the cross beams are arranged with the vertical columns in line, or in a V-shaped fashion, in a T-shaped fashion or in a crisscross fashion.

By using the above solution, the semi-butterfly connecting clamp of the present invention is designed as a semi-type connecting clamp on the basis of the design of the prior connecting clamp, which enables the connection with the cross beam being adjustable conveniently. The connecting clamp has the self-locking shoulder, the self-locking block will move along the direction of the movement of the spring while the spring being compressed or released. Since the direction of the bolt shank being inserted into the through hole and the locking bolt hole is arranged at an angle relative to the vertical direction, the self-locking block will move along the left and right direction in a horizontal plane, the distance between the friction shear resistant plates outside of the vertical column retained by the self-locking block is adjustable, thereby the requirement of the processing accuracy of the connecting clamp is lowered. When the connecting clamp is applied with an outside force, the self-locking block thereon will compress the spring, and thus the rigid action produced between the connecting clamps and the friction shear resistant plates outside of the vertical column can be weakened as a result of dissipating energy of the spring, so that the damaging force will be greatly reduced during a force is applied onto the vertical column by the friction shear resistant plates, thereby the whole building steel framework joint structure is protected.

The present invention will now be described in connection with the accompanying drawings and the embodiments as follows.

DETAILED DESCRIPTION OF THE PREFERRED EMBODIMENT

Figure 1A:
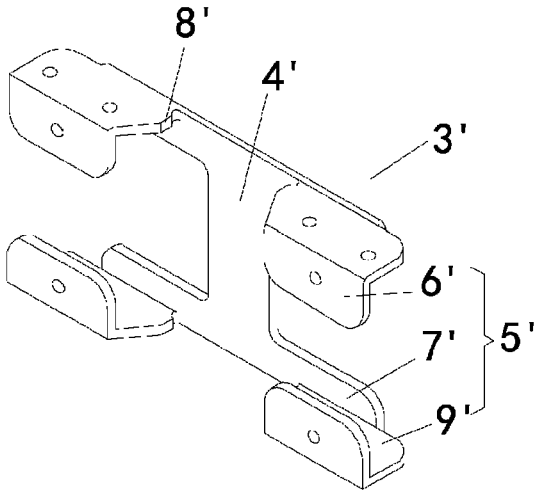
Fig. 1A Prior Art
FIG. 1A is an isometric view of a prior butterfly self-locking connecting clamp.
Figure 1B:
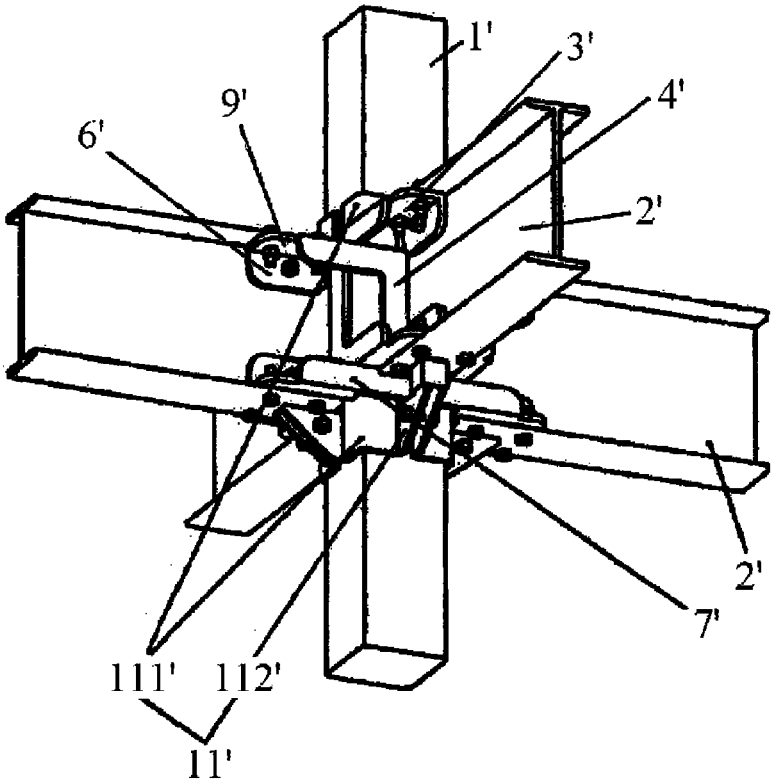
Fig. 1B Prior Art
FIG. 1B is an isometric view of a prior building steel framework joint structure.
Figure 2A:
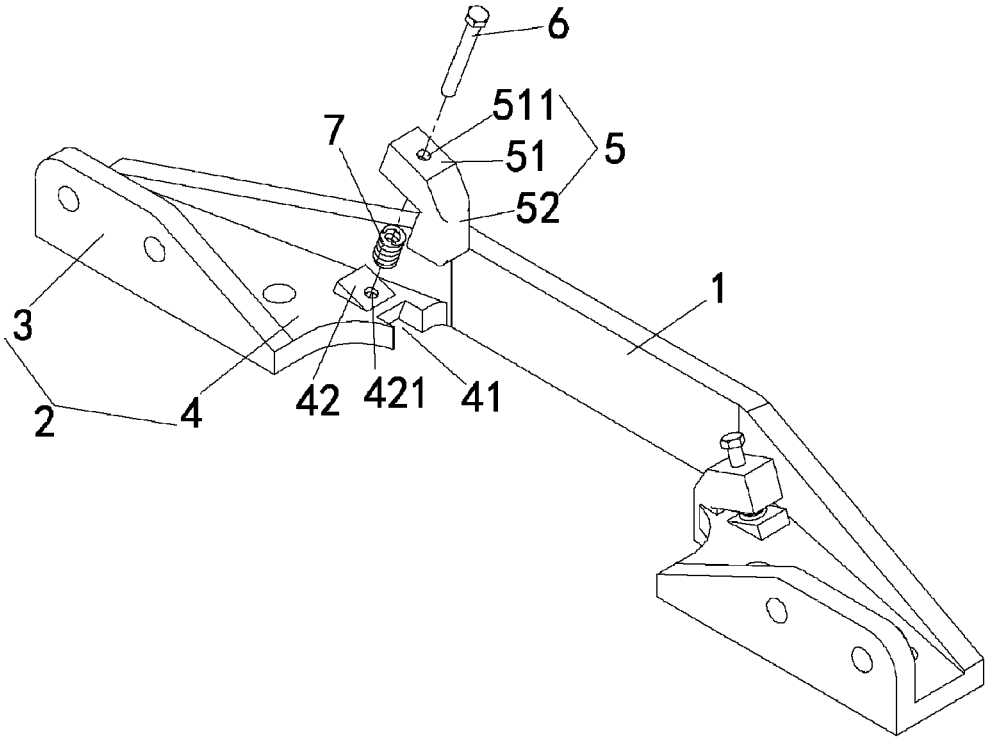
FIG. 2A is an isometric exploded view of a semi-butterfly connecting clamp according to the present invention.
Figure 2B:
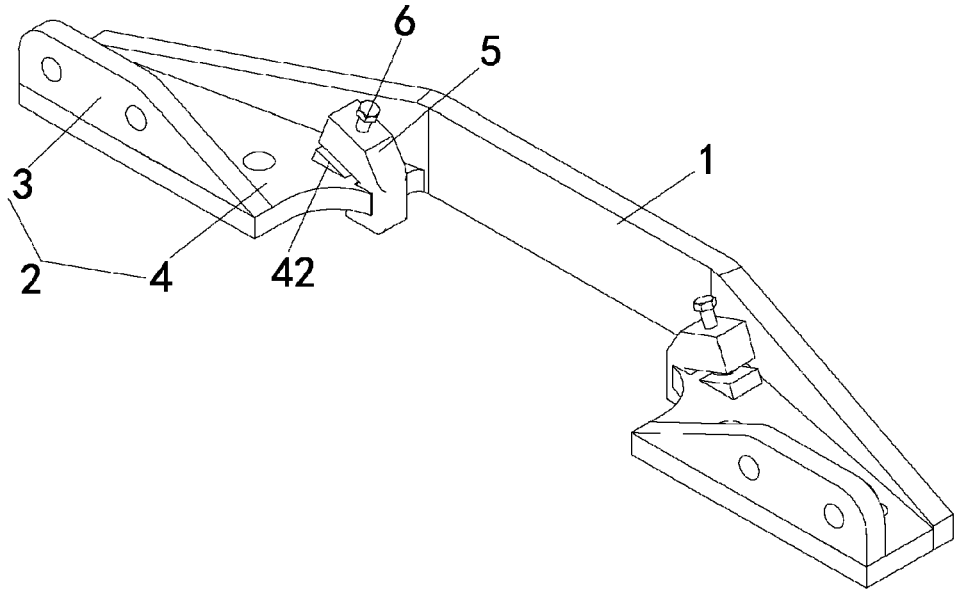
FIG. 2B is an isometric assembled view of the semi-butterfly connecting clamp according to the present invention.
Figure 2C:
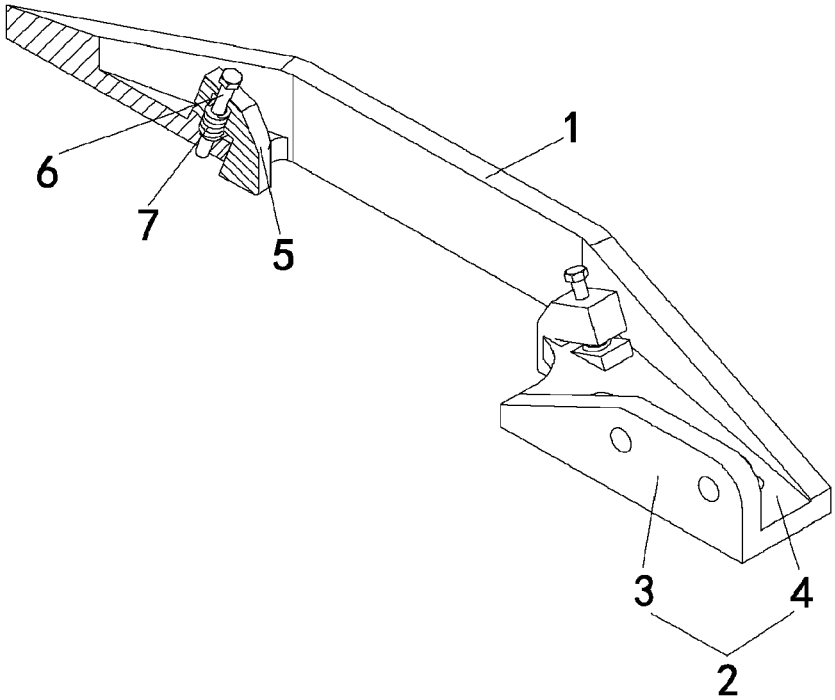
FIG. 2C is an isometric partially sectional view of the semi-butterfly connecting clamp according to the present invention.

As shown in FIGS. 2A and 2B, an isometric exploded view and an isometric assembled view of a semi-butterfly connecting clamp according to the present invention are provided, respectively. The connecting clamp comprises a bearing plate 1, an L-shaped self-locking block 5, a bolt 6 and a spring 7. Two clamp wings 2, each of which has an L-shaped section, are provided at left and right ends of the bearing plate 1, respectively. Each of the clamp wings 2 and the bearing plate 1 form a U-shaped clamp notch, each of the clamp wings 2 is integrally formed by a pre-tightening plate 3 opposite to the bearing plate 1 and a self-locking fastening plate 4 connecting the bearing plate 1 with the pre-tightening plate 3. The self-locking fastening plate 4 has two through holes, a groove 41 is provided at an end of the self-locking fastening plate 4 near the bearing plate 1, a wedge-shaped piece 42 is placed on an upper surface of the self-locking fastening plate 4 near the groove 41, an upper surface of the wedge-shaped piece 42 is an inclined surface inclining toward a middle lower part of the connecting clamp, wherein an angle β between the inclined surface and an upper surface of the connecting clamp is 73 degrees (as shown in FIG. 4A), the wedge-shaped piece 42 has a locking bolt hole 421 perpendicular to the upper surface thereof, and a surface of the groove 41 facing to a groove opening is perpendicular to the upper surface of the wedge-shaped piece 42. An upper part of the self-locking block 5 is a transverse rod 51 having a through hole 511 in the center thereof, and a lower part of the self-locking block 5 is a vertical rod 52 with a lower end thereof being inserted into the groove 41 and fitted with an internal surface of the groove 41. As shown in FIG. 2C, the bolt 6 is fastened with the locking bolt hole 421 together through the through hole 511 and the spring 7. The pre-tightening plate 3 is parallel to the bearing plate 1. A circular arc recess of the self-locking fastening plate 4 is provided between one end of the groove 41 and the bearing plate 1, and a connecting surface of the self-locking fastening plate 4 between the other end of the groove 41 and the pre-tightening plate 3 is a cambered surface. The pre-tightening plate 3 has two through holes.

Figure 3:
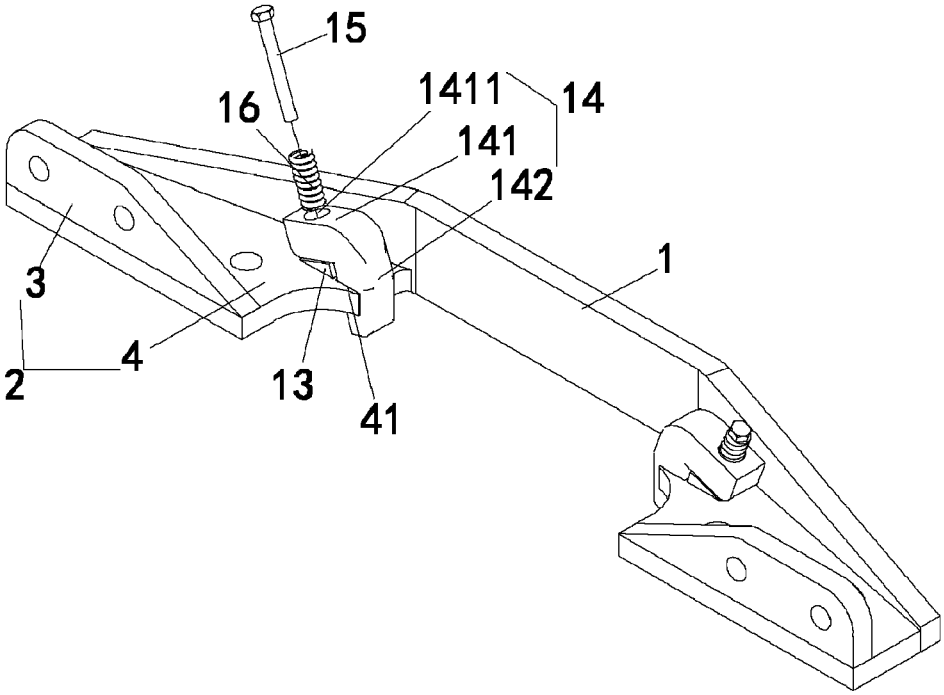
FIG. 3 is an isometric exploded view of a semi-butterfly connecting clamp according to another embodiment of the present invention.

Referring to FIG. 3, an isometric exploded view of a semi-butterfly connecting clamp according to another embodiment of the present invention is provided. The connecting clamp has the same structure with that shown in FIG. 2A, which comprises a bearing plate 1, and two clamp wings 2, wherein each of the clamp wings 2 is integrally formed by a pre-tightening plate 3 opposite to the bearing plate 1 and a self-locking fastening plate 4 connecting the bearing plate 1 with the pre-tightening plate 3, wherein the self-locking fastening plate 4 has two through holes, a groove 41 is provided at an end of the self-locking fastening plate 4 near the bearing plate 1. The difference is that an upper surface of the wedge-shaped piece 13 near the groove 41 is an inclined surface inclining toward the middle upper part of the connecting clamp, the wedge-shaped piece 13 has a locking bolt hole (not shown) perpendicular to the upper surface thereof, a surface of the groove 41 facing to a groove opening is perpendicular to the upper surface of the wedge-shaped piece 13, an upper part of the self-locking block 14 is a transverse rod 141 having a through hole 1411 in the center thereof, and a lower part of the self-locking block 14 is a vertical rod 142 with a lower end thereof being inserted into the groove 41 and fitted with an internal surface of the groove 41. The bolt 15 is fastened with the locking bolt hole together through the spring 7 and the through hole 1411.

Figure 4:
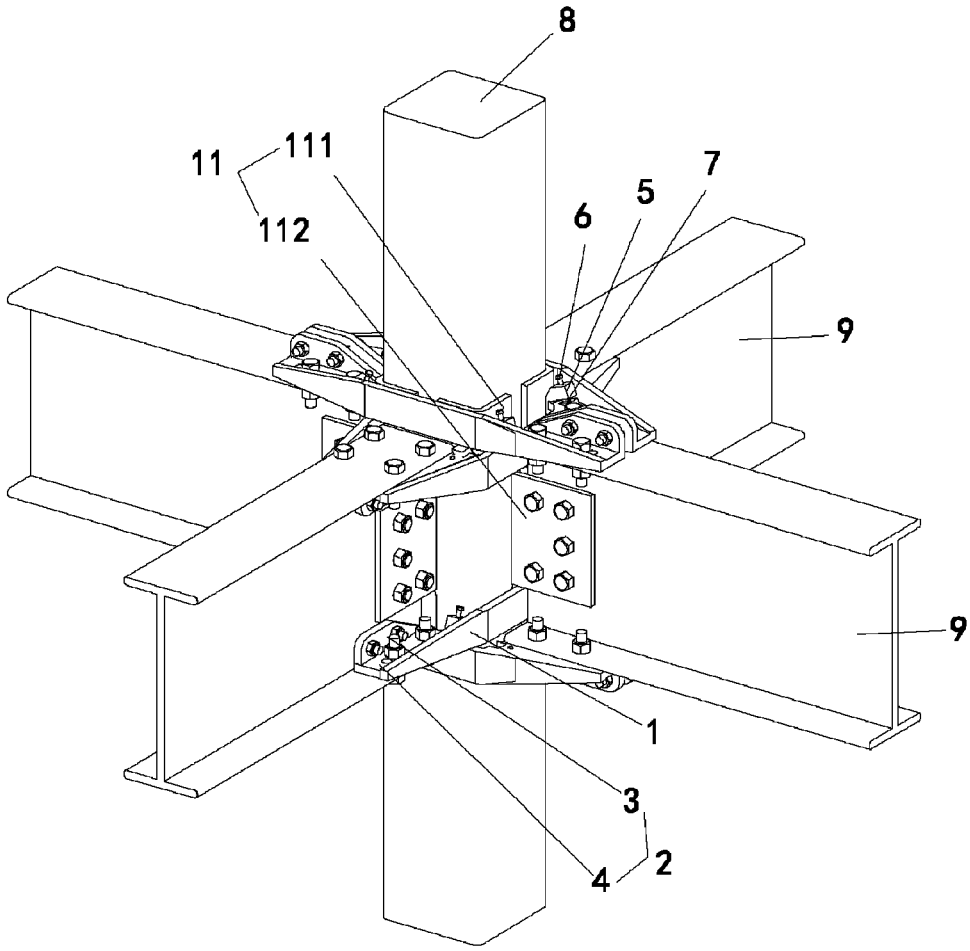
FIG. 4 is a schematic view of a building steel framework joint structure according to the present invention.
Figure 4A:
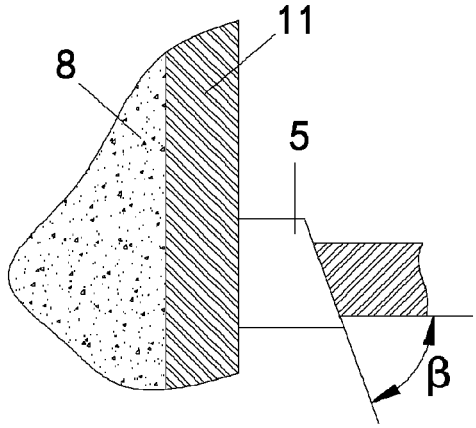
FIG. 4A is a partially schematic view of the building steel framework joint structure according to the present invention.
Figure 5:
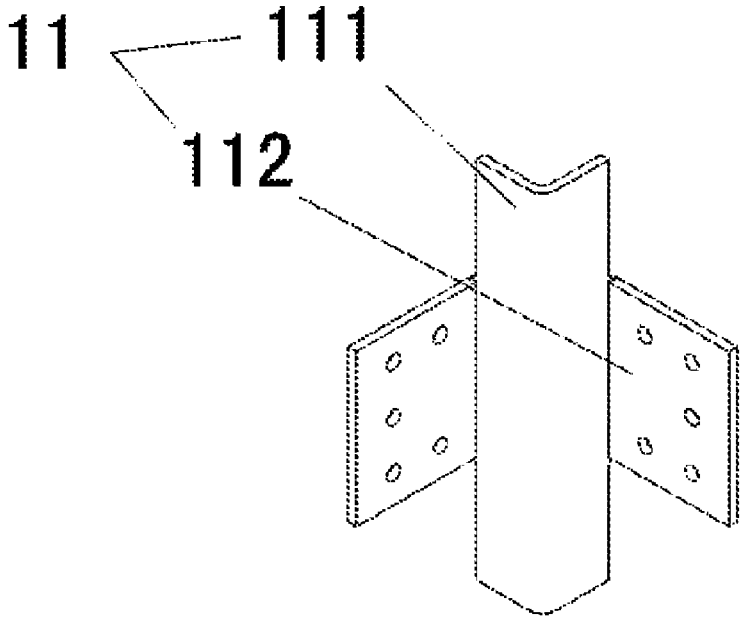
FIG. 5 is a perspective view of one of the shear resistant plates of the present invention.

FIG. 4 illustrates a schematic view of a building steel framework joint structure according to the present invention. The building steel framework joint structure comprises a vertical column 8, four I-shaped cross beams 9 arranged in the form of a crisscross intersection, eight semi-butterfly connecting clamps and four friction shear resistant plates 11. Each of the friction shear resistant plates 11 is formed by a friction plate 111 with a V-shaped cross section and two shear resistant plates 112 connected with middle parts of two sides of the friction plate 111, respectively. The friction plates 111 of the four friction shear resistant plates 11 are evenly distributed and fitted on outer surfaces of four corners of the vertical column 8, respectively. Each of the friction shear resistant plates 11 is located between the vertical column 8 and each of the connecting clamps. The shear resistant plates 112 of the adjacent friction shear resistant plates 11 and a web plate of the cross beam 9 between the two shear resistant plates 112 are fixed together by bolts. Every two connecting clamps forms a pair, the two connecting clamps of the pair are respectively located at two opposite sides of the vertical column 8, every two pairs of the connecting clamps form a group for fixing two cross beams 9 in line, wherein one pair of one group of the connecting clamps are located above upper flange plates of two longitudinal cross beams of four cross beams arranged in a crisscross fashion, and the other pair of the group of the connecting clamps are located below lower flange plates of the two longitudinal cross beams 9, and the self-locking fastening plates 4 of the group of the connecting clamps and the upper and lower flange plates of the two longitudinal cross beams 9 are bolted and fastened together. The other group of the connecting clamps are used for fixing two transversal cross beams 9 of the four cross beams arranged in a crisscross fashion, wherein one pair of the other group of the connecting clamps are located below upper flange plates of the two transversal cross beams, and the other pair of the other group of the connecting clamps are located above lower flange plates of the two transversal cross beams 9, the self-locking fastening plates 4 of the other group of the connecting clamps and the upper and lower flange plates of the two transversal cross beams 9 are bolted and fastened together. The pre-tightening plates 3 of the other group of the connecting clamps and the web plates of the two transversal cross beams 9 are bolted and fastened together. The pre-tightening plates 3 of each pair of the other group of the connecting clamps are fastened opposite to each other by bolts.

The semi-butterfly connecting clamp and the building steel framework joint structure according to the present invention are designed as a semi-type connecting clamp on the basis of the design of the prior connecting clamp, thus there is no need for a pre-designed accurate dimension of the connecting clamp when the connecting clamps are connected with the cross beams, which enables the connection with the cross beam being adjustable conveniently in different ways without any unfitting problems. The prior self-locking shoulder of the connecting clamp is replaced with a self-locking block, the self-locking block will move along the direction of the movement of the spring while the spring being compressed or released. Since the direction of the bolt shank being inserted into the through hole and the locking bolt hole is arranged at an angle relative to the vertical direction, the self-locking block will move along the left and right direction in a horizontal plane, thus the distance between two self-locking blocks on the connecting clamp can be adjusted, i.e. the distance between the friction shear resistant plates outside of the vertical column retained by the self-locking block is adjusted. In this way, the requirement of the processing accuracy of the connecting clamp is reduced, thus there is no any hidden troubles about waste product due to error process. Furthermore, when the semi-butterfly connecting clamp is applied with an outside force such as the action of earthquake, the strong force firstly acts on the self-locking blocks, then a force is applied onto the spring by the self-locking block, and thus a majority of energy produced by the rigid action produced between the semi-butterfly connecting clamps and the friction shear resistant plates on the outer surfaces of the vertical column will be dissipated due to dissipating energy of the spring therebetween, therefore the damaging force will be greatly reduced during the force is applied onto the vertical column by the friction shear resistant plates, thereby the whole building steel framework joint structure is protected.

Although the present invention has been described with reference to the preferred embodiments thereof, it will be understood that the above description should not be construed as limiting the scope of the present invention. Various substitutions and modifications may be made by those skilled in the art without departing from the spirit of the invention, and all such substitutions and modifications are intended to be embraced within the scope of the invention as defined in the appended claims.

INDUSTRIAL APPLICABILITY

The semi-butterfly connecting clamp and the building steel framework joint structure according to the present invention are mainly used for connecting and fixing the steel frame in construction engineering, and especially used for the fixing and connection between the load-bearing vertical column and the cross beams connected thereto of building. The connection structure according to the present invention has the advantages of strong load-bearing capacity, firmness and safety.

What is claimed is:

1. A semi-butterfly connecting clamp, comprising:

a bearing plate;

two L-shaped clamp wings provided at two ends of a side of said bearing plate, respectively, wherein each of said clamp wings and said bearing plate form a U-shaped notch, each of said clamp wings, integrally formed, comprises:

a pre-tightening plate opposite to said bearing plate and having at least one through hole; and a self-locking fastening plate connecting said bearing plate with said pre-tightening plate, wherein said self-locking fastening plate has at least two through holes, and a groove provided at an end thereof near said bearing plate;

wherein said self-locking fastening plate comprises a wedge-shaped piece placed on an upper surface of said self-locking fastening plate at a position near said groove;

wherein said wedge-shaped piece has an inclined upper surface and a locking bolt hole perpendicular to said inclined upper surface;

wherein a concave surface of said groove facing to an opening of said groove is perpendicular to said inclined upper surface of said wedge-shaped piece;

two inverse L-shaped self-locking blocks, each of which comprising:

a transverse rod having a through hole; and a vertical rod, wherein a lower end portion of which is inserted into said groove and fitted within an inner wall of said groove of said self-locking fastening plate;

two bolts, each of which being fastened with said locking bolt hole together through said through hole of said self-locking block; and two springs, whereby, each of said self-locking blocks is fastened with said self-locking fastening plate by each of said bolts penetrating through said through hole of said transverse rod, each of said springs and said locking bolt hole of said wedge-shaped piece.

2. The semi-butterfly connecting clamp, as recited in claim 1, wherein each of said springs is positioned between each of said self-locking blocks and said wedge-shaped piece when said upper surface of said wedge-shaped piece is tilted to a middle lower part of said connecting clamp, namely, one end of said upper surface of said wedge-shaped piece closing to a middle part of said connecting clamp is lower than the other end of said upper surface of said wedge-shaped piece away from said middle part of said connecting clamp.

3. The semi-butterfly connecting clamp, as recited in claim 1, wherein each of said springs is positioned above each of said self-locking blocks when said upper surface of said wedge-shaped piece is tilted to a middle upper part of said connecting clamp, namely, one end of said upper surface of said wedge-shaped piece closing to a middle part of said connecting clamp is higher than the other end of said upper surface of said wedge-shaped piece away from said middle part of said connecting clamp.

4. The semi-butterfly connecting clamp, as recited in claim 1, wherein said self-locking fastening plate has a circular arc recess between an end of said groove and said bearing plate, and a connecting surface between the other end of said groove and said pre-tightening plate.

5. The semi-butterfly connecting clamp, as recited in claim 4, wherein said connecting surface is a cambered surface.

6. The semi-butterfly connecting clamp, as recited in claim 4, wherein said connecting surface is an inclined surface.

7. The semi-butterfly connecting clamp, as recited in claim 1, wherein said pre-tightening plate is parallel to said bearing plate.

8. The semi-butterfly connecting clamp, as recited in claim 4, wherein said pre-tightening plate is parallel to said bearing plate.

9. The semi-butterfly connecting clamp, as recited in claim 1, wherein said pre-tightening plate is tilted to said bearing plate, so that an angle is provided between a plane where said pre-tightening plate is provided and a plane where said bearing plate is provided.

10. The semi-butterfly connecting clamp, as recited in claim 4, wherein said pre-tightening plate is tilted to said bearing plate, so that an angle is provided between a plane where said pre-tightening plate is provided and a plane where said bearing plate is provided.

11. A building steel framework joint structure, comprising:

a vertical column;

at least two I-shaped cross beams, each of which comprises an upper flange plate, a lower flange plate and a web plate provided between said upper and lower flange plates;

four friction shear resistant plates distributed evenly on outer surfaces of four corners of said vertical column, respectively, wherein each of said friction shear resistant plates, located between said vertical column and each of said cross beams and integrally formed, comprises:

a concaved friction plate; and two shear resistant plates connected with middle parts of two sides of said friction plate, respectively, wherein said shear resistant plates of adjacent friction shear resistant plates and said web plate of said cross beam between said two adjacent shear resistant plates are fixed together;

at least four connecting clamps, each of which comprises:

a bearing plate;

two L-shaped clamp wings provided at two ends of a side of said bearing plate, respectively, wherein each of said clamp wings and said bearing plate form a U-shaped notch, each of said clamp wings, integrally formed, comprises:

a pre-tightening plate opposite to said bearing plate and having at least one through hole; and a self-locking fastening plate connecting said bearing plate with said pre-tightening plate, wherein said self-locking fastening plate has at least two through holes, a groove provided at an end thereof near said bearing plate;

wherein said self-locking fastening plate comprises a wedge-shaped piece placed on an upper surface of said self-locking fastening plate at a position near said groove;

wherein said wedge-shaped piece has an inclined upper surface and a locking bolt hole perpendicular to said inclined upper surface;

wherein a concave surface of said groove facing to an opening of said groove is perpendicular to said inclined upper surface of said wedge-shaped piece;

two inverse L-shaped self-locking blocks, each of which comprising:

a transverse rod having a through hole; and a vertical rod, wherein a lower end portion of which is inserted into said groove and fitted within an inner wall of said groove of said self-locking fastening plate;

two bolts, each of which being fastened with said locking bolt hole together through said through hole of said self-locking block; and two springs, wherein each of said self-locking blocks is fastened with said self-locking fastening plate by each of said bolts penetrating through said through hole of said transverse rod, each of said springs and said locking bolt hole of said wedge-shaped piece;

wherein every two connecting clamps form a pair, said two connecting clamps of said pair are respectively located at two opposite sides of said vertical column, said pre-tightening plates of said pair of connecting clamps are placed opposite to each other, said upper and lower flange plates of said cross beam are arranged above or below said self-locking fastening plates bolted with said upper and lower flange plates, said pre-tightening plate has at least one through hole, said pre-tightening plates of said pair are fastened opposite to each other.

12. The building steel framework joint structure, as recited in claim 11, wherein each of said springs is positioned between each of said self-locking block and said wedge-shaped piece when said upper surface of said wedge-shaped piece is tilted to a middle lower part of said connecting clamp, namely, one end of said upper surface of said wedge-shaped piece closing to a middle part of said connecting clamp is lower than the other end of said upper surface of said wedge-shaped piece away from said middle part of said connecting clamp.

13. The building steel framework joint structure, as recited in claim 11, wherein each of said springs is positioned above each of said self-locking blocks when said upper surface of said wedge-shaped piece is tilted to a middle upper part of said connecting clamp, namely, one end of said upper surface of said wedge-shaped piece closing to a middle part of said connecting clamp is higher than the other end of said upper surface of said wedge-shaped piece away from said middle part of said connecting clamp.

14. The building steel framework joint structure, as recited in claim 11, wherein said self-locking fastening plate has a circular arc recess between an end of said groove and said bearing plate, and a connecting surface between the other end of said groove and said pre-tightening plate.

15. The building steel framework joint structure, as recited in claim 14, wherein said connecting surface is a cambered surface.

16. The building steel framework joint structure, as recited in claim 14, wherein said connecting surface is an inclined surface.

17. The building steel framework joint structure, as recited in claim 11, wherein said pre-tightening plate is parallel to said bearing plate.

18. The building steel framework joint structure, as recited in claim 14, wherein said pre-tightening plate is parallel to said bearing plate.

19. The building steel framework joint structure, as recited in claim 11, wherein said pre-tightening plate is tilted to said bearing plate, so that an angle is provided between a plane where said pre-tightening plate is provided and a plane where said bearing plate is provided.

20. The building steel framework joint structure, as recited in claim 14, wherein said pre-tightening plate is tilted to said bearing plate, so that an angle is provided between a plane where said pre-tightening plate is provided and a plane where said bearing plate is provided.

* * * * *